United States Patent [19]

Zhadanov

[11] 4,228,558

[45] Oct. 21, 1980

[54] WATER IMPELLER BRUSH AND MASSAGE

[76] Inventor: Semen Zhadanov, 2944 W. 5th St., Brooklyn, N.Y. 11224

[21] Appl. No.: 10,516

[22] Filed: Feb. 9, 1979

[51] Int. Cl.[3] ..... A46B 13/04

[52] U.S. Cl. ..... 15/29

[58] Field of Search ..... 15/23, 24, 28, 29, 97 R; 128/47, 50, 53, 56

[56] References Cited

U.S. PATENT DOCUMENTS

| | | | |
|---|---|---|---|
| 1,606,821 | 11/1926 | Anderson | 15/29 |
| 2,599,911 | 6/1952 | Haines | 15/29 |
| 2,678,457 | 5/1954 | Demo et al. | 15/29 |
| 2,717,403 | 9/1955 | Batlas et al. | 15/29 |

*Primary Examiner*—Edward L. Roberts

*Attorney, Agent, or Firm*—Ostrolenk Faber Gerb & Soffen

[57] ABSTRACT

A shower massage head having rotating brushes and an outlet for a shower including intake and outlet conduits connected to a rotor. The rotor blades are so arranged that they do not extend to the center of the rotor thereby providing relief against back pressure on the rotor blades that would slow the rotor. The rotor is also eccentrically mounted adjacent to an inlet port so that as the rotor is rotated by the water input the eccentric mounting causes a rapidly increasing cross-sectional path for the exit of water at the periphery of the rotor. A gate valve is provided in the exit section so that all of the water which is operated at the brush or rotor may be exhausted or all of the water may be directed to a shower head or a division may be made between exhaust and shower head to control the shower head flow. Various other attachments may be used including an eccentrically mounted massaging device operated by the rotor from a platform connected to the rotor having an eccentric drive stub shaft.

11 Claims, 19 Drawing Figures

FIG. 9
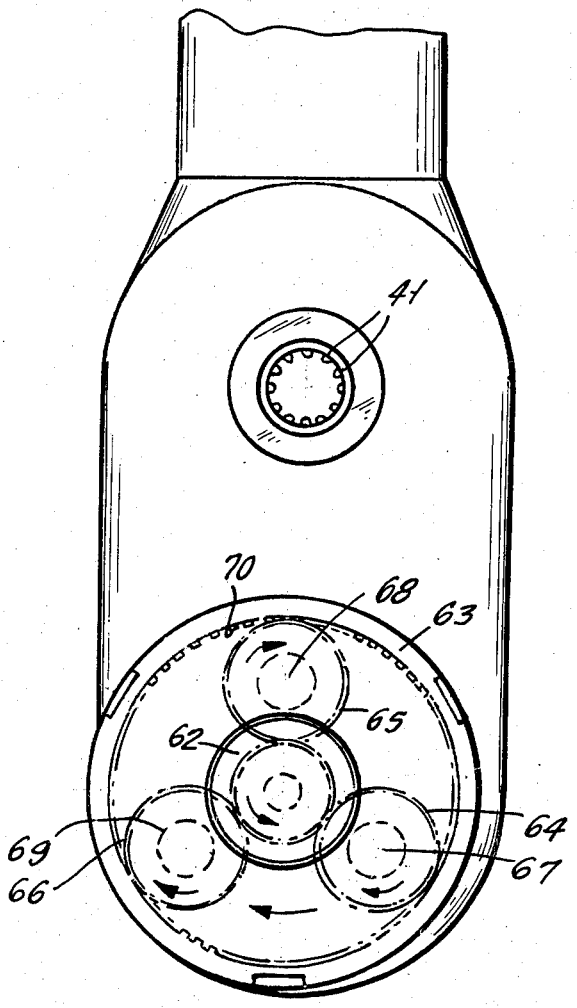
FIG. 14
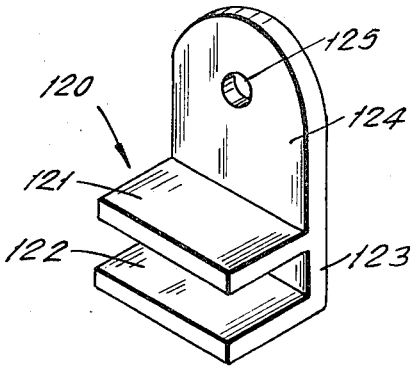
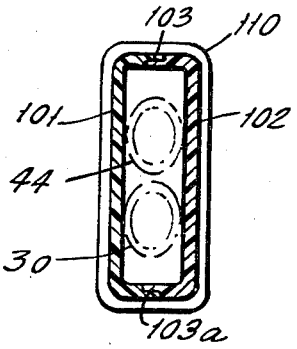
FIG. 13

FIG. 15.
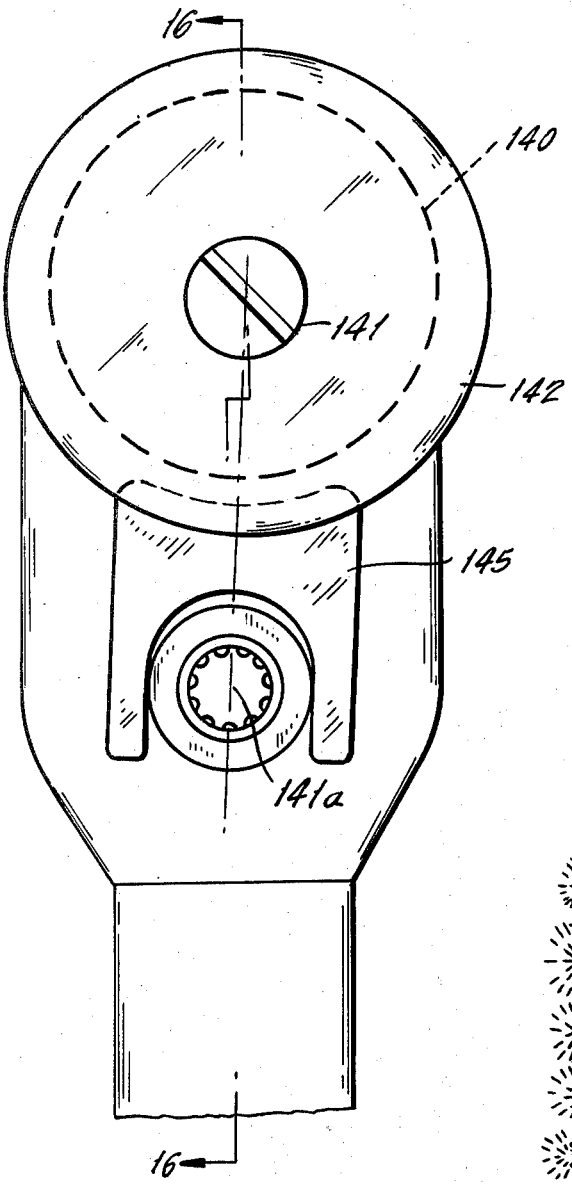
FIG. 16.
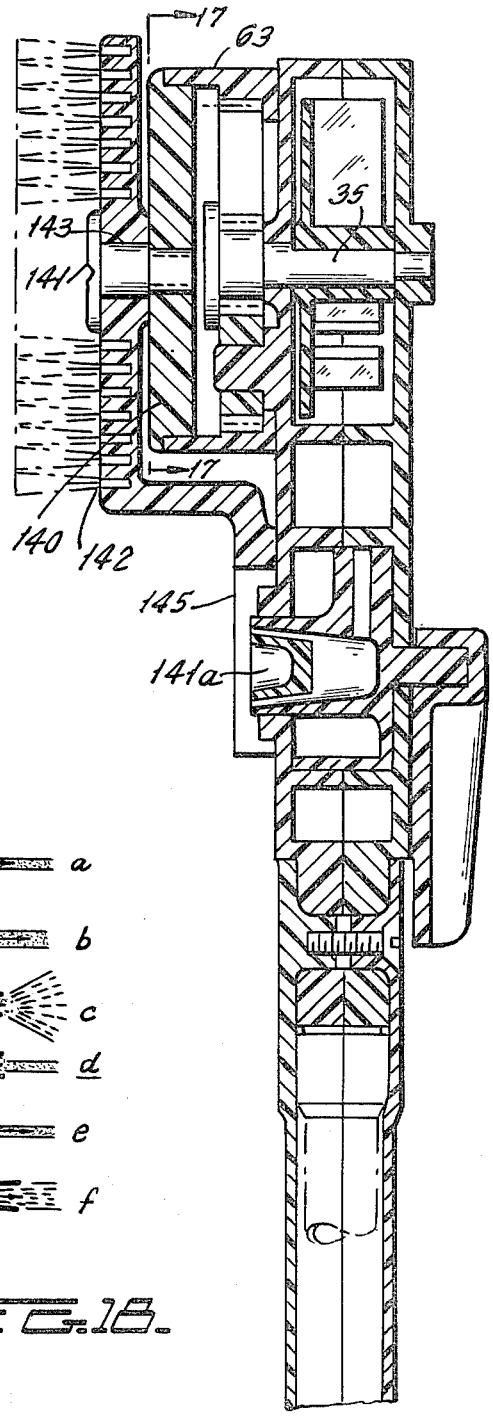
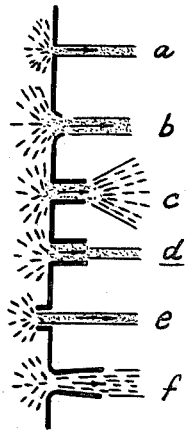
FIG. 18.
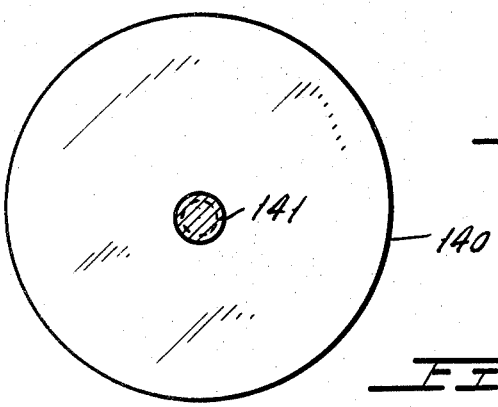
FIG. 17.

WATER IMPELLER BRUSH AND MASSAGE

The present invention relates to a cleaning and massaging device which is water impelled and may preferably be attached to a water outlet in the bathroom of a home or other location.

Essentially, the cleaning and massaging device comprises a rotor which drives a brush or other cleaning device; other devices may be substituted for the cleaning device such as a massage pad and the like.

The essential element of the present invention is that the water input to the rotor is so arranged as to provide a high degree of impelling force to the blades of the rotor.

In order to avoid backup pressure on the rotor and to permit the rotor to respond to the actual hydraulic pressure of the water input, the water outlet is arranged so that it is much larger than the water input and even the rotor is so arranged that the water which drives the blades will have a path to exhaust even before the water outlet is reached. Therefore, the water at the center will whirl at high speed without interference providing, not only a fast exhaust path, but also additional high speed impulse for the rotor blades.

In order to carry this out, one of the essential elements of the present invention is the arrangement of the rotor so that the blades do not extend fully across the rotor.

In prior devices it has been customary to arrange the rotor blades so that they extend from the center of the rotor to the outermost section of the rotor. In other devices, various blades or other devices for receiving the input of the water under pressure have been so arranged that, while they do not extend across the entire rotor, extend sufficiently around the rotor so that water which has been used to impel the blades on one side must be carried around by the rear of the next adjacent blade to an outlet port and thereby create a backup or detaining force on the rotor itself.

Therefore, the rotor blades of the present invention are so arranged that they extend somewhat radially of the rotor in a direction to receive the direct force of the water input; but the blade does not extend fully to the center of the rotor. This provides a place for the spent water to go so that the water does not exert a dragging force on the rotor and provides especially at the center the high speed exhaust and whirling effect above mentioned.

In addition the rotor is mounted eccentrically of the device in such a manner that since, while the rotor itself rotates on its own center, the center is displaced to one side of the device toward the input channel, the exit channel thus can be made much wider. Almost immediately after the water impinges on each rotor blade the blade is moved to a point where the passage between the rotor and the housing begins to increase radially in width toward the exit port which is substantially parallel to the intake port and where the exit port is much wider than the intake port.

Thus, one of the major problems which arises in connection with the use of rotors for such massage devices where water is available at some pressure but not at any very substantially elevated pressure (such as in a home water supply) is obviated since the rotor is not confronted with the problem of fighting the back pressure of water which has already done its job but cannot readily be disposed of.

The major object of the present invention therefore is the arrangement of rotor input ports and outlet ports so that the water which has done its work on any particular rotor blade is able to escape radially from the rotor blade to reach a much wider exit outlet than the inlet port and thereby furnish minimal or no back pressure to the operation of the rotor.

Another important feature of the present invention is the utilization of an input port which according to Bernoulli's theorem is so arranged as to provide a jet entry for the input port. The relationship between the diameter of the port and the length and diameter of the tube is used to provide a hard jet rather than a conical stream or spray. The hard jet, impinging on the rotor blades, provides maximum driving force. Depending on the head of the water the jet of water may actually contract in the narrower exit tube and will emerge initially as a thin stream, even thinner than the diameter of the exit tube to provide a high pressure jet. Thus, the head or pressure of the water alone is not utilized for the provision of appropriate water pressure at the rotor, but the utilization of the small tube at the end of the water input with the small tube having a sharp boundary with the larger water input provides a jet directed essentially at the center of each rotor blade with substantial force to drive the rotor blade, while at the same time the water "brooming" out when striking the rotor blade will now be permitted to escape radially outwardly and toward the center of the rotor so that back pressure from the water after it has given up its energy will not act as a deterrent to the rapid rotation of the rotor. The water which is utilized to operate the rotor may also be utilized to operate a spray or shower head carried by the device which carries the rotor. In this case, the outlet port may be connected directly to a shower head in the same unit or the outlet port may be connected to an outlet pipe. Thus the device of the present invention has a pipe or tube leading to an inlet port and a pipe or tube extending from the outlet port. The end of the outlet pipe or tube may be loose so that the water will flow freely out of it or may be connected to an appropriate drain. The two tubes may be interconnected externally as hereinafter described in order to provide an easily operable and easily handleable device.

One of the other major aspects of the present invention is the provision of a water gate valve in the device at the outlet section. The water gate valve is so arranged that it may be moved between two selected positions and an intermediate position between the two selected positions. In one selected position the gate will simply transmit all the outlet water to the outlet tube and to waste and none of the water will go to the shower head. In a second position of the gate all of the outlet water will be directed to the shower head and not to the outlet tube. In a third position intermediate the first two positions, the gate will be so arranged that part of the water will reach the outlet tube and part of the water will reach the shower head. Thus, the user will at all times have full speed operation of the brush but may select full on operation of the shower head, partial operation of the shower head or no water at all through the shower head.

In addition, the handle parts which contain the outlet tubes may be so arranged that they may be adjusted to different curvatures for different uses of the shower-massage head; and provision may be made for hanging the shower head in a position where it will provide a shower without the need to hold it by hand. In addition to the rotor operated massage which may be obtained either by direct operation of the brush by the rotor or direct operation of a massage head by the brush, an oscillating type of massage may be obtained as hereinafter described.

Thus, the primary object of the present invention is the provision of a cleaning and shower head in which a rotor for driving a cleaning brush or a massaging device is so arranged that it receives the full impact of water to drive the rotor directly at approximately the center of the rotor blades with provision being made by the location of the rotor blades on the rotor so that the water may escape radially both outwardly and inwardly to diminish the back pressure on the rotor blades and permit the full power of the water input to be used.

A further object of the present invention is the utilization of a jet type of inlet operating in accordance with Bernoulli's theorem that will provide a jet input for the rotor blade even though the head or pressure of the initial water supply is lower than might be expected to produce the same result.

A further object of the present invention includes the positioning of the rotor blades so that the water may immediately escape and thereby avoid back pressure thereon and to provide an immediate increase of the output area for the water, as the rotor rotates, toward a much larger outlet port than the entry port.

A further object of the present invention is the arrangement of the massage and rotor head so that it also has a shower head and the provision of a water gate valve so arranged that it may selectively discharge all of the water which drives the rotor without passing through the shower head or may be arranged to pass all of the water after it leaves the rotor to the shower head or it may divide the water between the outlet port and the shower head.

A prior application of applicant Ser. No. 839,601 filed Oct. 5, 1977 and abandoned contained the following prior art which is made of record in this application:

U.S. Pat. No. 1,487,466—Norris—Mar. 18, 1924
U.S. Pat. No. 2,717,403—Batlas et al—Sept. 13, 1955
German Patent No. 2,433,575—Hansmann—January, 1976
Italian Patent No. 646,243—Seris—September, 1962
Swiss Patent No. 361,489—Spengler—May, 1962

The foregoing and many other objects of the present invention will become apparent from the following description and drawings in which:

FIG. 9 is a view partly in phantom corresponding to a portion of FIG. 1 showing the planetary gear drive from the rotor to the brush head, which may be used in those cases where the brush is not connected directly to the rotor.

Figure 8:
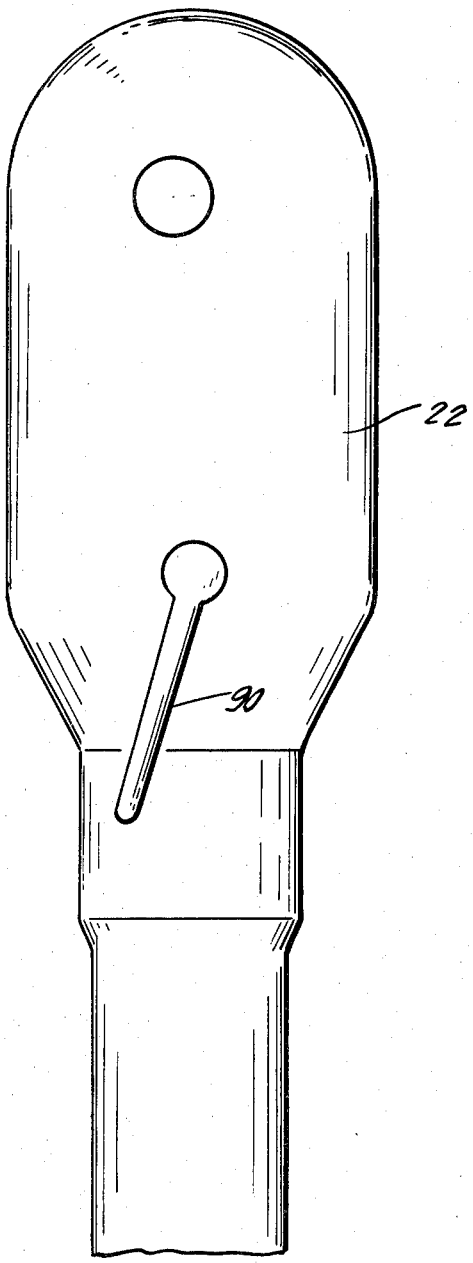
FIG. 8 is a view corresponding to the right hand portion of FIG. 7 showing the valve operator in place.
Figure 10A:
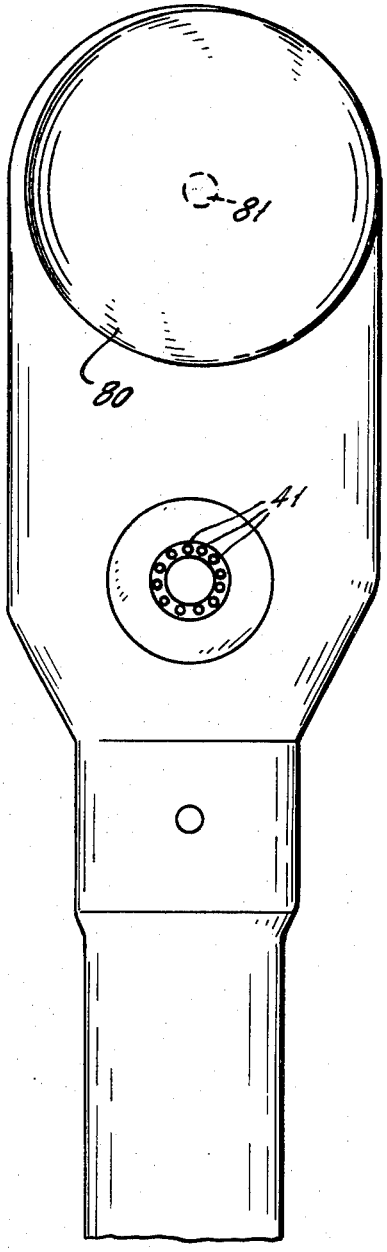
FIGS. 10, 11 and 12 are different views of the arrangement of the handle members which contain the inlet and output tubes so that they may be bent and retained in any desired position.

FIG. 10*a* is a view corresponding to that of FIG. 8 showing the opposite side of the water impeller brush massage device.

Figure 10:
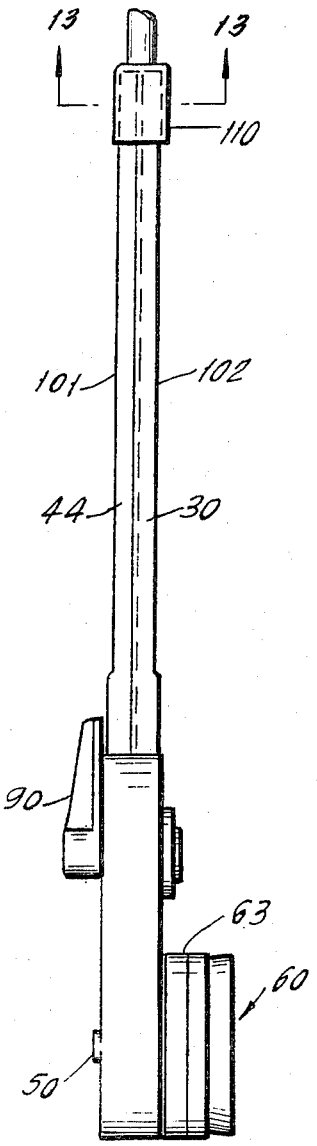

FIG. 13 is a cross-sectional view taken on line 13—13 of FIG. 10 looking in the direction of the arrows.

FIG. 14 is a view of a hanger which may be used in connection with the shower massage head of the present invention.

FIG. 15 is a view showing the mounting of an eccentric massage device on the structure of the present invention.

FIG. 16 is a view partly in cross-section taken on line 16—16 of FIG. 15 looking in the direction of the arrows.

FIG. 17 is a view partly in cross-section taken on line 17—17 of FIG. 16 looking in the direction of the arrows.

FIG. 18 is a diagrammatic view showing the application of Bernoulli's theorem to different outlet tube lengths and different heads of water. The relationship here preferred is that shown in orifice and tube d.

Referring first to FIGS. 1 through 8 inclusive, the structure of the present invention includes a shower massage head 20 which is formed from a pair of preferably molded walls 21, 22 appropriately shaped to retain and position the rotor 25 and the valve gate 26.

Figure 3:
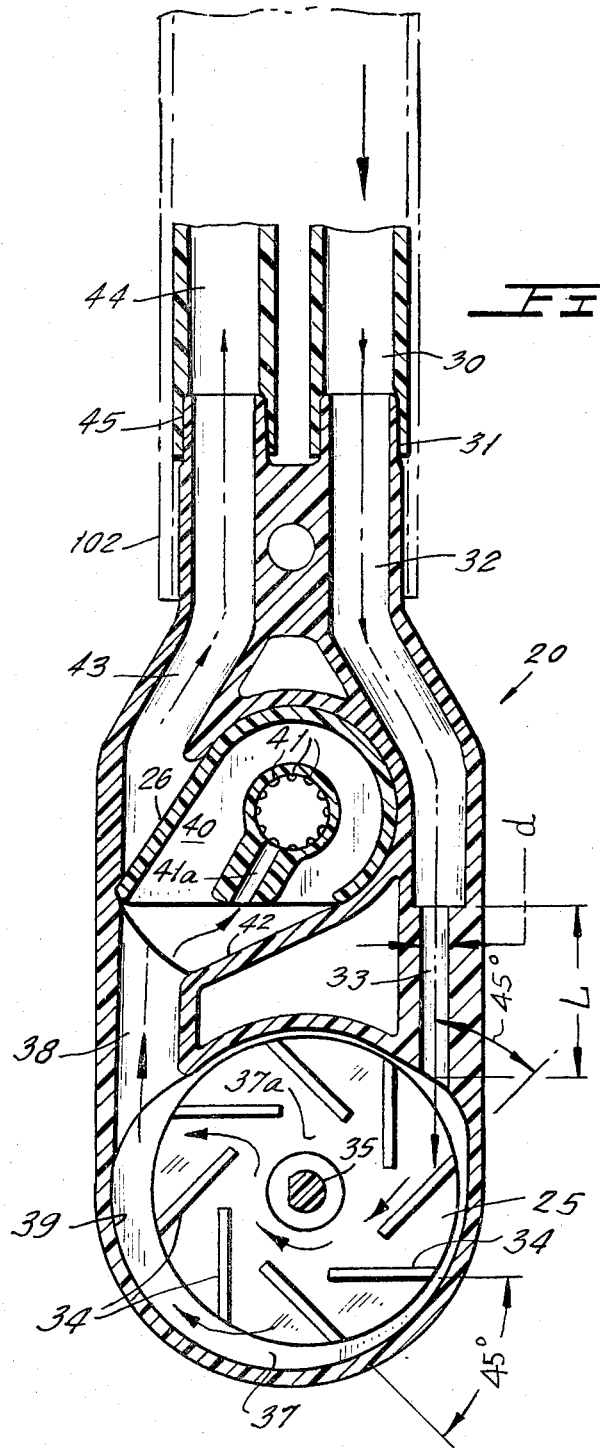
FIG. 3 is a view partly in cross-section taken on line 3—3 of FIG. 2 looking in the direction of the arrows and showing the position of the valve gate so that all of the exhaust water goes through the shower head.

For the following decription, FIG. 3 may be referred to as being exemplary of the other figures in illustrating the basic aspects of the present invention. Water enters from any suitable source into the tube 30. The tube 30 is connected to the housing 20 at the nipple 31 which is connected to the water passage 32 which extends as may be noted from FIG. 3 on one side of the valve gate structure 26.

The water passage 32 terminates in the Bernoulli nozzle 33 to provide a jet which may impinge on the blades 34 of the rotor 25. The blades are so arranged that the major component of the jet force impinging on each successive blade 34 is in a tangential direction with respect to the rotating pivot 35 of the rotor 34. The blades 34 do not extend to the rotating pivot 35. The spent water exiting from the jet 33 and impinging on the successive blades 34 may now escape and thereby reduce any back pressure on the blades toward the center area 37*a* of the rotor between the inner ends of the blades and the pivot 35. The water may also escape owing to the fact that the pivot 35 of the rotor is eccentrically mounted with respect to the housing 20 and thus a steadily increasing exit passage 37 is provided within the housing which in turn communicates with the exit conduit 38 providing an exit from the section of the housing 39 which houses and retains the rotor 35. The water exiting into conduit 38 may now, owing to the position of the gate valve 26 which intersects the exit outlet 38 pass into the passage 40 of the gate valve 26 and to the shower head outlet 41. In the case shown in FIG. 3 all of the water may now escape only through the shower head openings 41 and thus provide a full shower in addition to the operation of the rotor.

Figure 4:
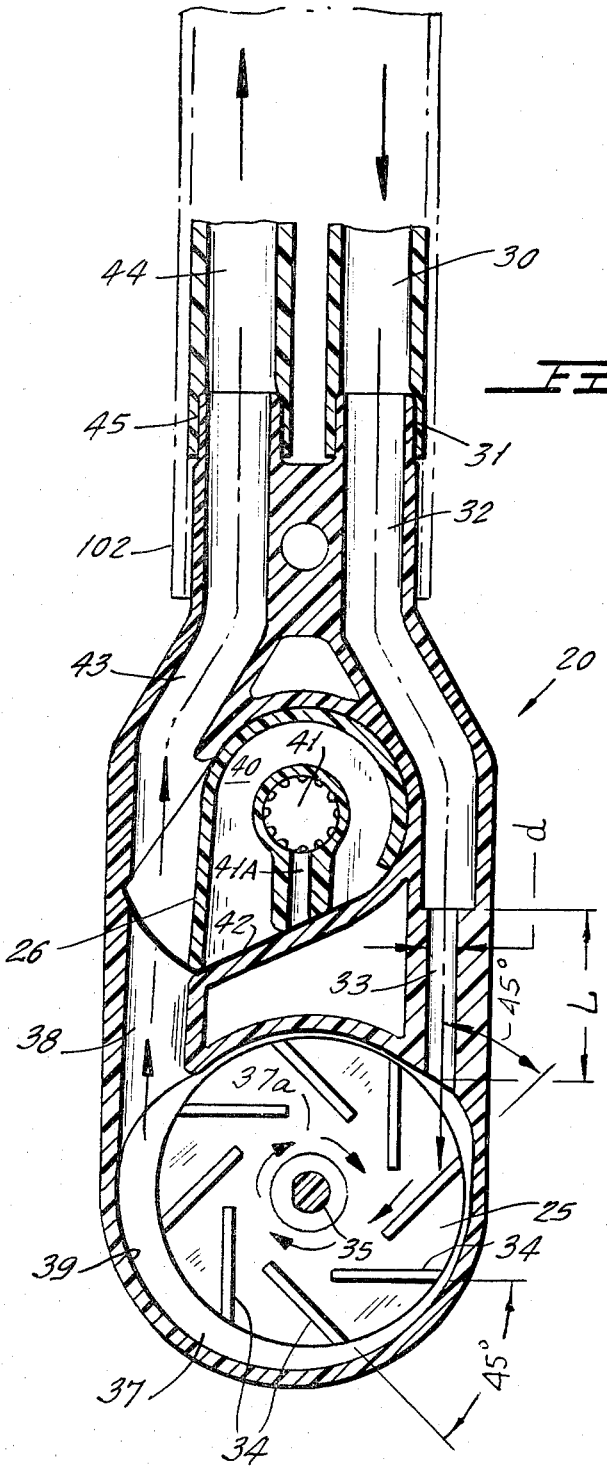
FIG. 4 is a view corresponding to FIG. 3 showing a different position of the valve gate so that no shower operation is obtained.

As seen in FIG. 4, the gate valve 26 may be rotated so that its passage 40 is completely blocked by the wall 42 and the exit passage 38 within the housing communicates with the further exit 43 passage of the housing which, in turn, extends to the exhaust tube 44 which is connected to the housing by the nipple 45.

Figure 5:
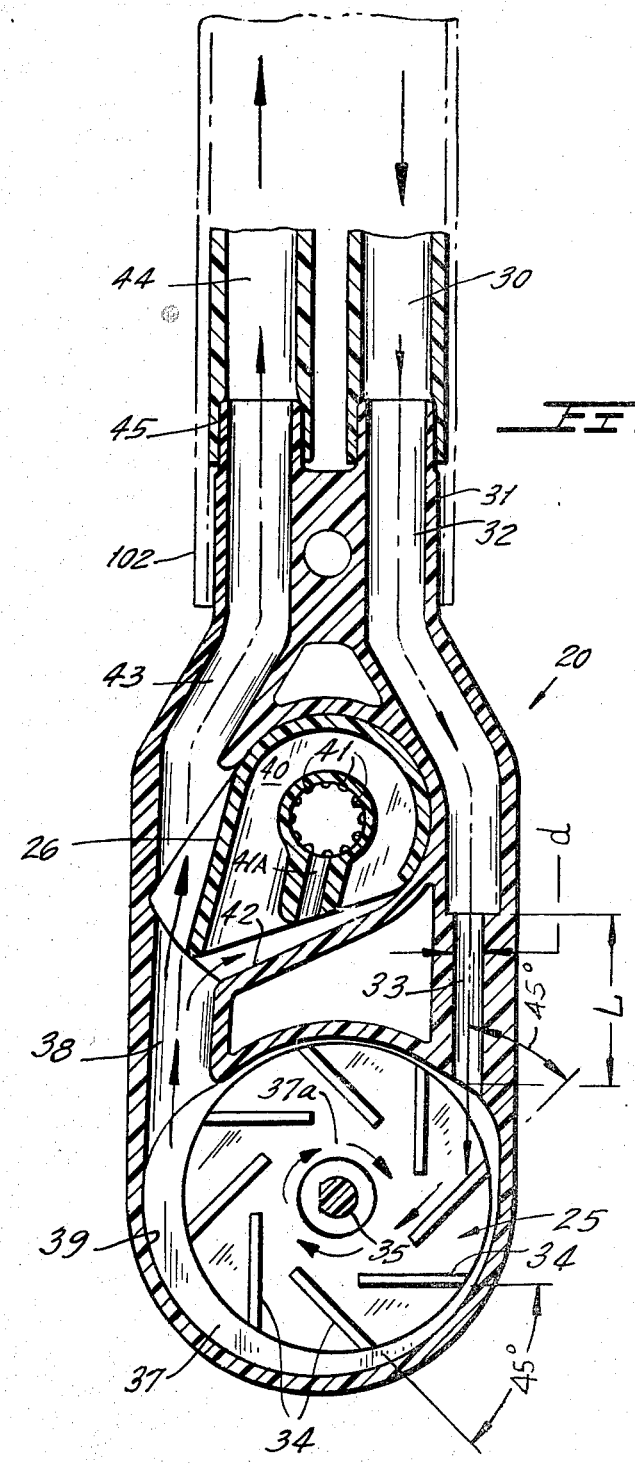
FIG. 5 is a view coresponding to FIGS. 3 and 4 showing an alternate position of the valve gate so that there is partial operation of the shower head and partial exhaust of the spent water.
Figure 6:
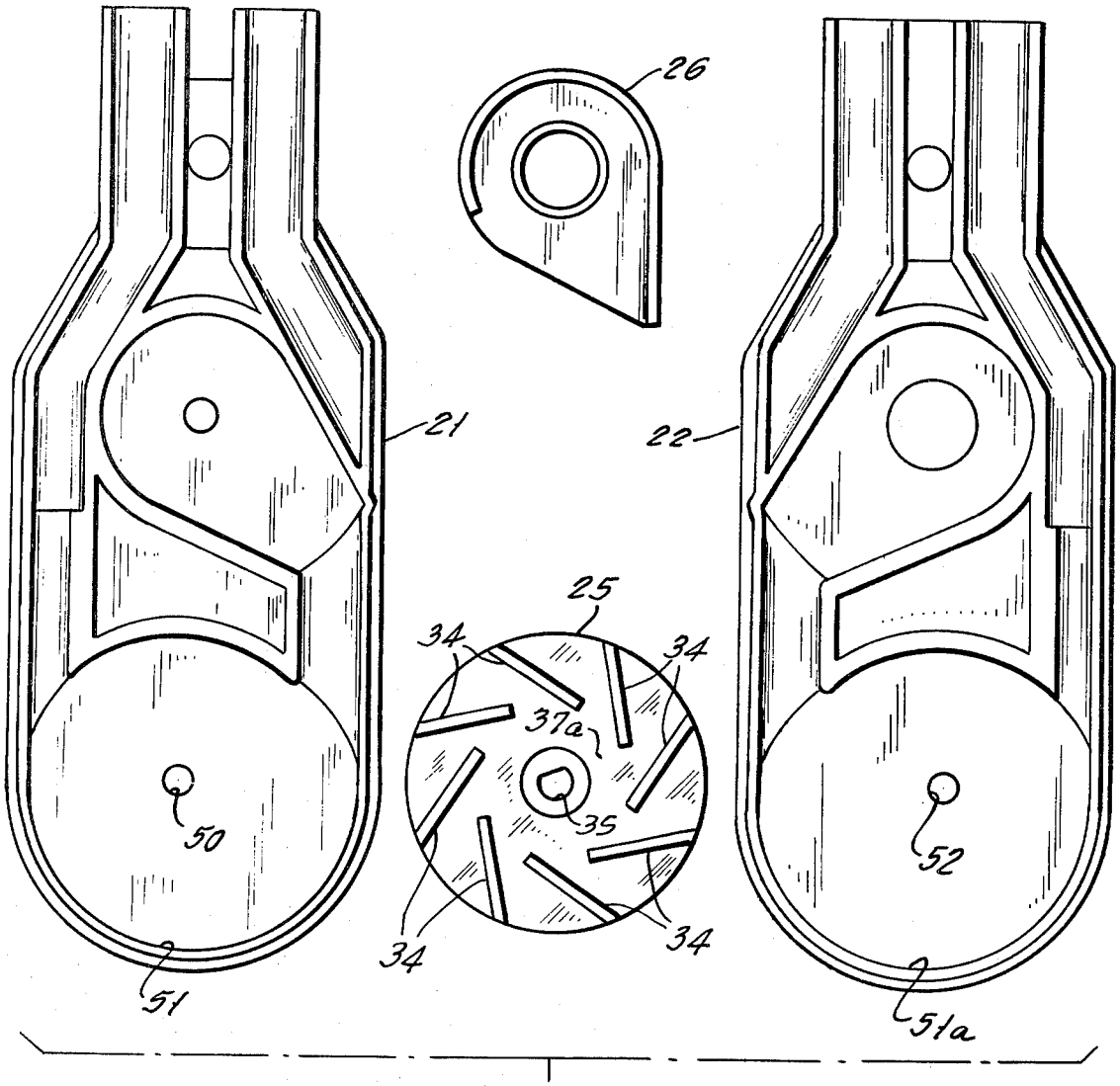
FIG. 6 is an expanded view showing the interior of the top and bottom halves of the casing for the novel shower massage pressure head and the rotor and valve gate.
Figure 7:
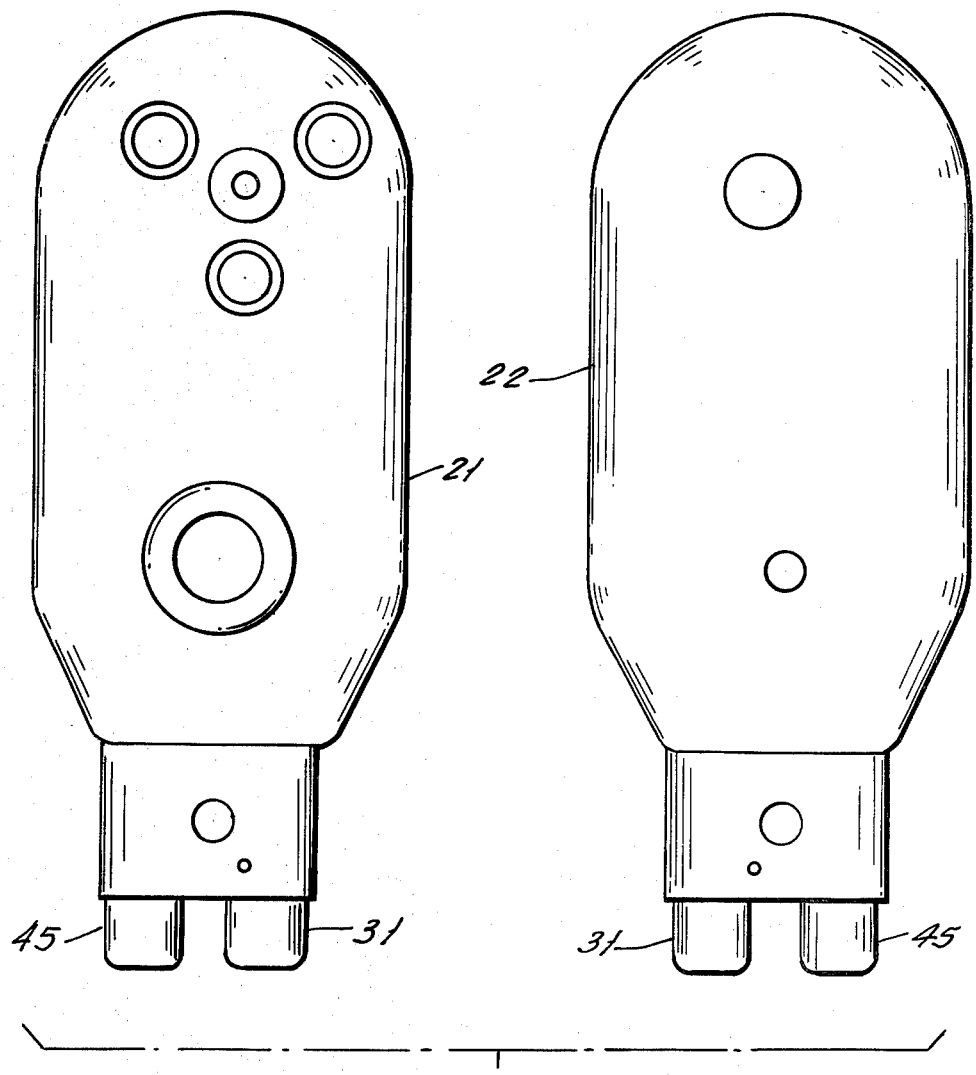
FIG. 7 is a composite view showing the exterior of the back or outer portion of each of the top and bottom halves of the structure of FIG. 6.

As seen in FIG. 5, the water gate valve 26 may be rotated so that the section 40 thereof partly intercepts only a part of the water from the passage 38 so that part of the water goes to the exit passage 43 and the exhaust tube 44 and part of it goes to the interior passage 40 of the gate valve 26 to the shower head. It will be noted here that the total of the shower openings 41 add up to less than the cross-sectional diameter of the conduit 38 so that when the water exits through the shower opening 41 back pressure is applied to the rotor 25 halting the brush. Thus no additional means are required to turn off the brush when a full shower is desired.

Thus, the gate valve 26 may be adjusted to the intensity of the shower spray desired apart from the rotor speed which is obtained. The rotor speed is thus dependent entirely on the operation of the rotor itself, the utilization of the jet tube 33 and the head of water which is provided.

As will be seen from the comparison of FIGS. 3, 4 and 5 the device may be set so that all of the water will go through the shower head, part of the water will go through the shower head or none of the water will go through the shower head. In the FIG. 4 setting (all water going to exhaust) the gate valve blocks opening 41*a* leading to shower head 41.

The center post 35 of the rotor is mounted in the bearing 50 in the rotor chamber 51 of the upper section 21 of the housing (see FIG. 6) and extends through the opening 52 of the rotor chamber section 51*a* in the opposite section 22 of the rotor housing.

Figure 1:
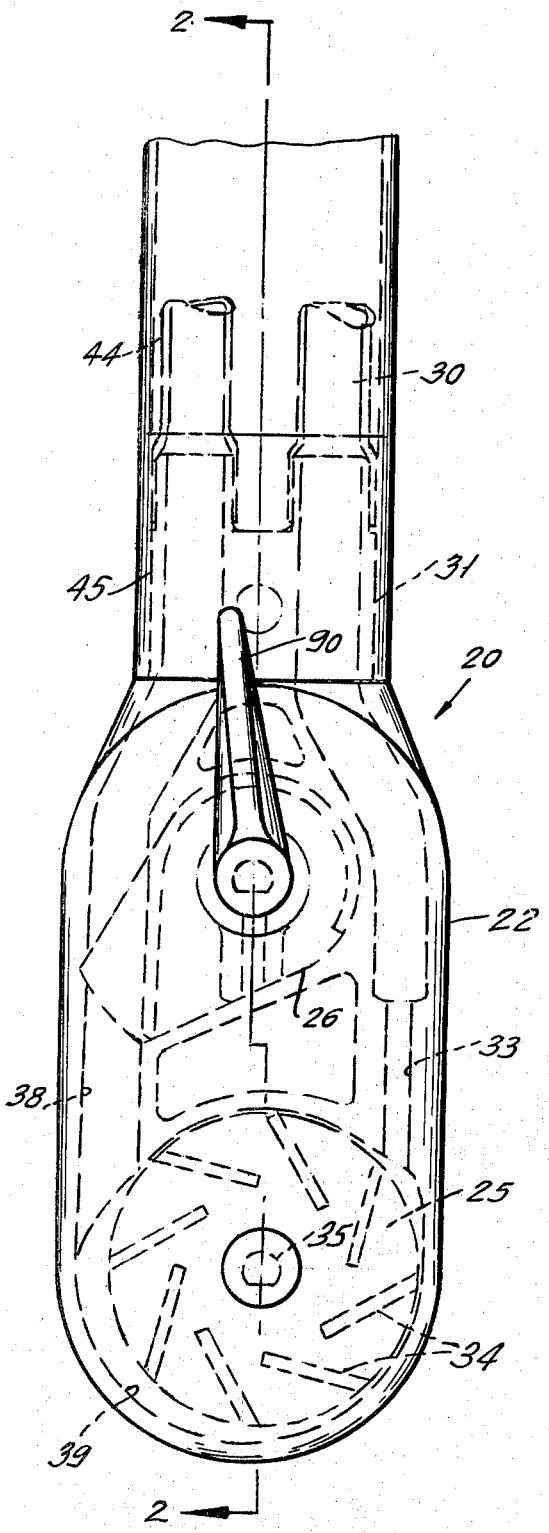
FIG. 1 is a back view partly in phantom of the novel shower head of the present invention.
Figure 2:
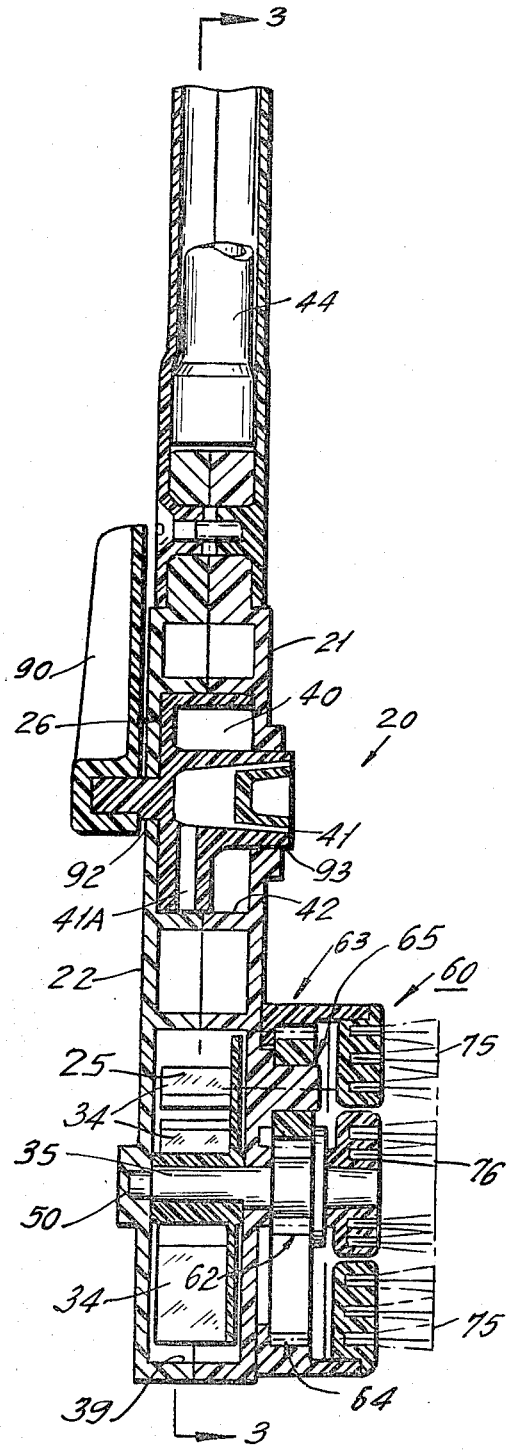
FIG. 2 is a cross-sectional view taken on line 2—2 of FIG. 1 looking in the direction of the arrows.

As seen in FIGS. 1 and 2, a brush 60 may be mounted directly on the shaft 35 for rotation thereby; although preferably the rotor is arranged so that it drives the sun gear 62 in the additional internal gear 63 (see FIGS. 2 and 9). The sun gear 62 drives the stationarily mounted planetary gears 64, 65, 66 mounted on the stationary posts 67, 68, 69 which in turn are connected to the inner teeth 70 of the internal gear 63. The internal gear 63 carries brush bristle sections 75 and the central sun gear 62 carries the central brush 76. The operation is thus one in which the central brush 76 is rotated in one direction and the outer brush bristles 75 are rotated in the opposite direction to produce both a brushing and a massage.

If desired a massage head 80 (see FIG. 10*a*) which would merely be in the form of a cup may be placed over the outer brush bristles 75 to produce a device which will rub rather than brush. If desired also the massage head may be eccentrically weighted in a manner not shown but obvious to those skilled in the art so that rotation about its center which will coincide substantially with the rotor shaft 35 will, owing to the eccentric weighting of the massage head, cause oscillation.

As shown in FIGS. 15, 16 and 17 another form of a massage head may be used and this will be described in detail later.

As shown particularly in FIGS. 1, 8, and 10*a* the gate valve 26 is provided with the exterior handle 90 which may rotate the gate valve from the full shower position of FIG. 3 to the no shower position of FIG. 4 or to any intermediate position therbetween as illustrated in FIG. 5. Appropriate detents (not shown) may be provided for, especially, the intermediate positions to provide plural grades of partial shower.

The gate valve 26 as shown particularly in FIG. 2 is mounted in its own bearing 92 in the wall 22 of the shower massage head and in a bearing 93 which surrounds the shower head openings 41.

In FIGS. 10 through 13 there is shown an arrangement of the handle for the tubes whereby the pair of input and output tubes 30 and 44 are encased in a pair of relatively stiff members 101, 102 which constitute half tubular sections slidingly connected together at the side seams 103, 103*a*. The members 101, 102 are relatively stiff and may be slid with respect to each other. One end thereof (see FIG. 4) is slid over the pair of nipples 31, 45 and up onto a portion of the housing in order to provide an anchor therefor. These tubes are held together as seen in FIGS. 10 to 13 by the close fitting ring of rectangular cross-section 110.

Figure 11:
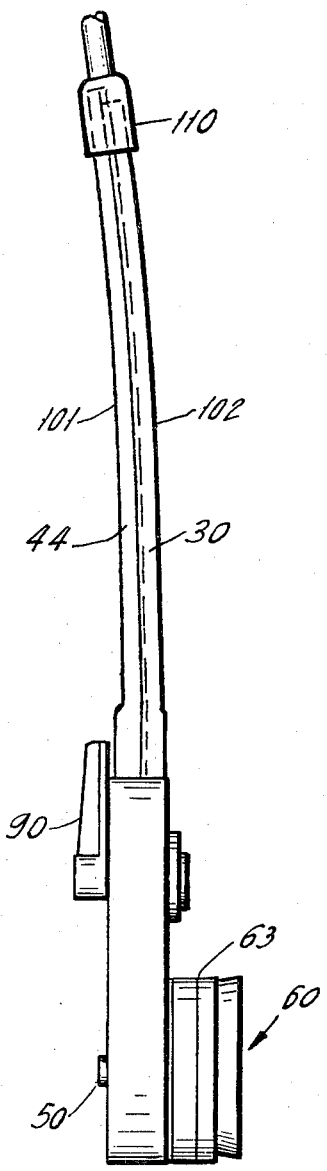
Figure 12:
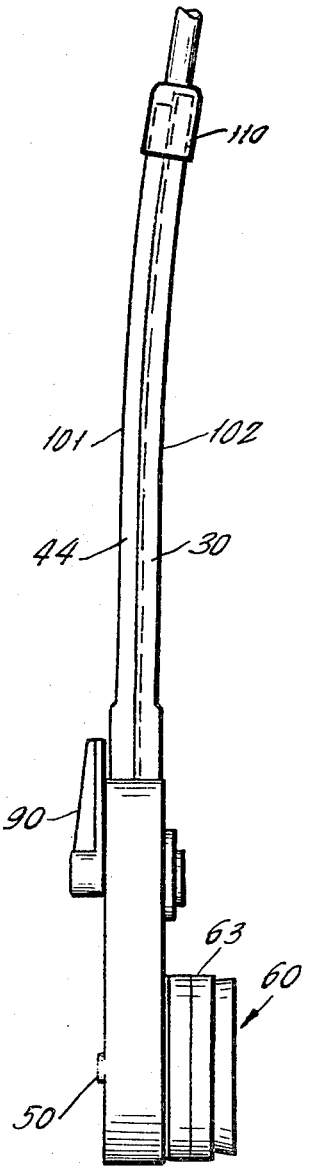

When the members 101 and 102 are slid with respect to each other to different positions as shown in FIGS. 10, 11 and 12, they will form a curvature since the inner member will follow a shorter path and extend beyond the outer tube as shown by a comparison of FIG. 11, on the one hand, with FIG. 12 and a comparison of FIG. 12, on the other hand, with FIG. 10. The rectangular collar 110 maintains the present relationship between the members 101, 102 when bent to arcuate form; they will stay in that form and thus provide a relatively stiff end member for the hoses 30 and 44 leading to the nipples 31 and 45, respectively. This provides a stiffening structure where it is desired so that in effect the massage and brush device, without being provided necessarily with a handle of its own, will have an adjustable handle provided by the combination of the sliding half tubular members 101 and 102 and the collar 110.

Where desired, a plastic or other clamp 120 (FIG. 14) is provided having the extending legs 121 and 122 which are spaced to resiliently engage the composite tube formed by the members 101, 102 and capture them. The legs 121, 122 are connected to a back wall 123 which is extended upwardly to the hanging member 124 provided with any suitable means such as the opening 125 to hang the shower and massage brush device from any appropriate hook or other hanging device.

While the utilization of the unit of the present invention as a shower and massage device has been referred to and the utilization of a cup member over the brush has been suggested as one massage device which does not necessarily provide a brushing action, it is possible as shown in FIGS. 15, 16, and 17 to provide either a brush or massage which will not rotate but will operate in an oscillatory fashion.

A member 140 may be substituted for the outer brush elements in any appropriate manner and secured to a base which in turn is secured to the internal gear 63 in any suitable manner. The additional rotatable disc 140 is provided with a stub shaft 141 which is eccentric with respect to the rotor drive shaft 35. Consequently, stub shaft 141 describes an orbital motion around the center of the shaft 35.

The regular brush may be used; a massage cap 142 may be secured over the member 140 with the recess 143 thereof in engagement with the eccentric stub shaft 141. An extension 145 of the massage member 142 is provided to engage the shower exit portion 141*a* of the device and the shower exit portion may be appropriately adapted to receive and position the engagement member 145.

It will thus be seen that as the disk 140 is rotated by the rotor on shaft 35 the interengagement of stub shaft 141 and recess 143 causes the massage member 142 to oscillate around the extension 141*a* of the shower section thereby producing not a circular but an oscillatory motion.

In the foregoing, the present invention has been described solely in connection with preferred illustrative embodiments thereof. Since many modifications and variations of the present invention will now be obvious to those skilled in the art it is preferred that the scope of the invention be determined not by the specific disclosures herein contained but only by the appended claims.

What is claimed is:

1. A shower head; comprising:

a housing including a generally circular portion;

a water inlet opening for said housing and a water outlet opening for said housing;

means for connecting water conduits to said respective inlet and outlet openings;

means for passing water out of said housing in the form of a shower spray;

a rotor mounted within and eccentric with respect to said generally cylindrical portion of said housing, said rotor including a base having a plurality of blades mounted thereon, said blades being so positioned that they are rotated by the force of water exiting said inlet opening;

said blades of said rotor extending substantially radially of said rotor but having a gap between the inner end of each blade and the center of said rotor providing a means for dissipation of water under pressure thereinto;

a rotor massage member coupled to said rotor for rotation therewith;

said eccentric mounting of said rotor providing a steadily increasing spacing between the outer ends of said blades of said rotor and the inner wall of the housing in the area of said generally cylindrical portion to provide further relief for water under pressure as the water is directed to said outlet.

2. The head of claim 1 wherein the angle of attack of water input to the blades of said rotor is of the order of 45°.

3. The head of claim 2 wherein the rotor is provided with and drives a platform; the platform is provided with a driving stub eccentric of the center of rotation of said platform; a member mounted on said platform and having a recess therein engageable with said driving stub on said platform; said member having an extension engageable with a stationary point on said device remote from the center of rotation of said rotor; the rotation of said rotor thereby causing the member to oscillate about said point.

4. The head of claim 3 wherein the center of rotation of the member mounted on the said platform is controlled by and constitutes the section of the device which forms the shower head.

5. The head of claim 1 wherein at said inlet opening adjacent the portion thereof directed toward said blades, a reduced diameter extension is provided directed towards said blade; said reduced diameter extension abruptly changing to said reduced diameter from the larger diameter of the inlet opening in accordance with the length-diameter relationship defined by Bernoulli's theorem.

6. The head of claim 1 wherein said means for passing water out of said housing is an exit opening for the spent water which has passed through the blades of said rotor; a gate valve in the outlet path of said water; said gate valve having a passage therein; said gate valve being rotatable to a position where the said passage intercepts all of the water passing toward said outlet port and directs said water to said shower head; said gate valve being selectively movable to a second position where it intercepts none of the water passing toward said outlet port and thereby provides no water to said shower head and said gate valve being movable to intermediate positions where the exit water is split between the outlet port and said shower head.

7. The head of claim 6 wherein the total area of the shower openings is less than the cross-sectional area of the water inlet opening whereby, when the gate valve is set for the position of full flow to the shower openings, the rotor is halted.

8. The head of claim 7 wherein said rotor drive member comprises:

a sun gear;

at least one planetary gear stationarily mounted in engagement with said sun gear and a gear ring engaging said planetary gear;

an inner and an outer brush;

means for connecting one of said brushes to said sun gear to be driven thereby; and means for connecting said other of said brushes to said ring gear to be driven thereby, whereby said inner and outer brushes rotate in opposite directions.

9. The head of claim 6 in which said gate valve is provided with a bearing inside said housing; a post extending through said housing on the side thereof opposite said shower head and a handle on said post for rotating said gate valve to the said selected positions.

10. The head of claim 1 wherein said water conduits connected to said inlet and outlet openings are flexible tubes; and a pair of stiffening members secured over the section of said tubes adjacent the connection thereof to said housing; the said stiffening members being slidable with respect to each other to set the tubes relatively stiffly selectively axially straight and parallel to each other or arced in selected opposite directions with respect to each other; and a collar on said stiffening members to retain the same in the selected set position.

11. The head of claim 10 in which a suspension member is provided connected to said stiffening members for supporting said device.

* * * * *